United States Patent [19]
Remington

[11] 4,287,732
[45] Sep. 8, 1981

[54] PADLOCK

[75] Inventor: Richard C. Remington, Pompton Plains, N.J.

[73] Assignee: Presto Lock Company, Division of Walter Kidde & Company, Inc., Garfield, N.J.

[21] Appl. No.: 70,101

[22] Filed: Aug. 27, 1979

[51] Int. Cl.[3] ..... E05B 27/22
[52] U.S. Cl. ..... 70/38 C; 70/DIG. 54
[58] Field of Search ..... 70/38 C, 38 B, 38 A, 70/38 R, 39, 25, 26, DIG. 54, DIG. 55

[56] References Cited

U.S. PATENT DOCUMENTS 506,665 10/1893 Browne ..... 70/38 C

FOREIGN PATENT DOCUMENTS 601486 8/1934 Fed. Rep. of Germany ..... 70/38 C
535725 1/1922 France ..... 70/38 C
944206 10/1948 France ..... 70/38 C
340472 5/1936 Italy .

*Primary Examiner*—Robert L. Wolfe
*Attorney, Agent, or Firm*—Shapiro and Shapiro

[57] ABSTRACT

A key-actuated padlock comprises a shackle, a case to receive the shackle and a flat, substantially U-shaped spring within the case. One leg of the spring serves as a bolt to restrain the movement of the shackle and the other leg serves as an ejector, urging the shackle out of engagement with the bolt leg. The bolt leg is formed to receive a key to unlock the padlock.

14 Claims, 10 Drawing Figures

PADLOCK

BACKGROUND OF THE INVENTION

This invention relates to padlocks, and more particularly to small key-actuated padlocks of the type useful on luggage and similar articles.

Small key-actuated padlocks are used on luggage, sports equipment bags, and similar articles to provide a certain degree of security for the contents of such articles. It is desirable that these padlocks be simple in construction and inexpensive to manufacture.

Prior padlocks generally have a comparatively large number of component parts. Typically, they include a plurality of individually spring-biased tumblers mechanically coupled together in a mechanism which operates a bolt. The bolt is engageable with a shackle to restrain its movement relative to the padlock case in order to lock the padlock. When a key is inserted into the lock, the tumblers are repositioned in a predetermined manner to permit the bolt to disengage from the shackle. The shackle, under the biasing influence of a spring, can then move to an unlocked position, wherein one end of the shackle may move out of the case. Because of the comparatively large number of component parts, such padlocks are costly to produce. Each part must be individually manufactured, and the numerous parts must be assembled. This is time-consuming, particularly when the components are small and difficult to manipulate. Furthermore, as the number of parts which comprise the locking mechanism increases, the possibility of a malfunction or failure of the mechanism increases.

it is desired to provide key-actuated padlocks which overcome the aforesaid disadvantages, and it is to this end that the present invention is directed.

SUMMARY OF THE INVENTION

It is a principal object of the invention to provide a new and improved key-actuated padlock.

It is a further object to provide a padlock having a minimum number of component parts and which can be manufactured and assembled simply and inexpensively.

In accordance with the invention, a padlock which satisfies the above objectives comprises a shackle, a case to receive the shackle, and first and second spring members within the case engageable with the shackle. The first spring member serves as a bolt to restrain the movement of the shackle. The second spring member functions as an ejector, urging the shackle out of engagement with the bolt.

In accordance with more specific aspects of the invention, one leg of the shackle has a notched portion adjacent to one end. The spring members are comprised of a flat, substantially U-shaped spring, each end of which is forked. The forked ends of the spring are engageable with the notch portion of the shackle. One leg of the spring serves as the bolt and the other leg of the spring serves as the ejector.

These, and other objects, advantages, features, and improved results provided by the invention will become apparent from the following detailed description and drawings of the preferred embodiment of the invention.

DESCRIPTION OF THE PREFERRED EMBODIMENT

Figure 1:
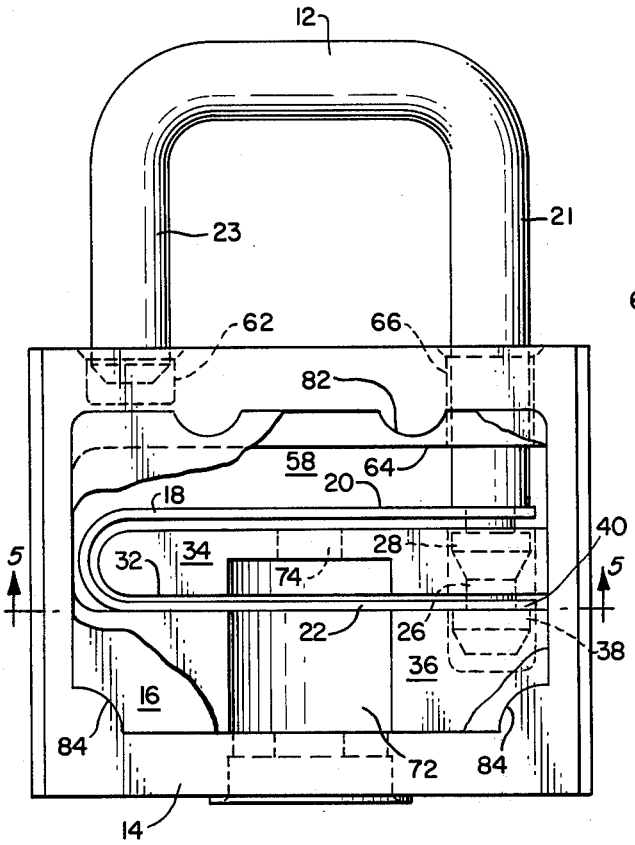
FIG. 1 is a side elevation view, partially broken away, illustrating a padlock in accordance with the invention, the padlock being shown in locked position.
Figure 2:
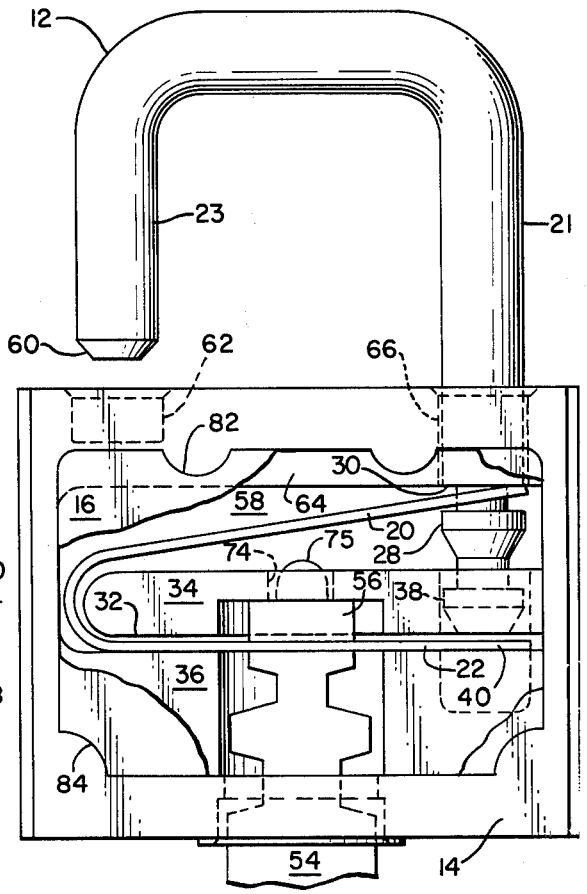
FIG. 2 is a view similar to FIG. 1 showing the padlock in unlocked position with a key, partially shown, inserted into the padlock.

Referring to FIGS. 1 and 2, the padlock includes a shackle 12, a case 14 to receive the shackle, a cover plate 16 (partially shown) and a spring 18 mounted within the case. The spring performs a dual function. It serves both as a bolt for restraining the movement of the shackle and as an ejector urging the shackle to unlocked position (FIG. 2).

Figure 3A:
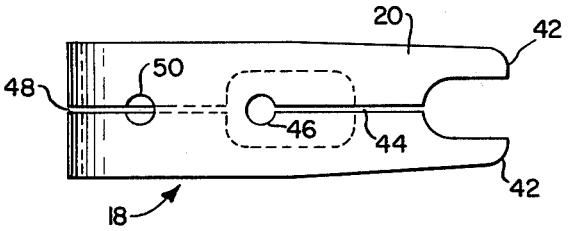
FIGS. 3A–3C are, respectively, a top, side, and bottom view of the spring and bolt component of the assembly.
Figure 3B:
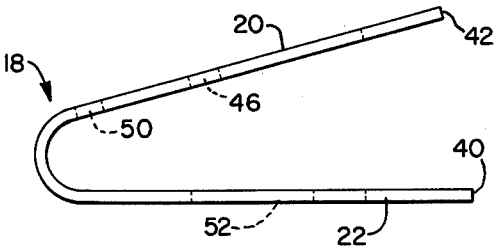
Figure 3C:
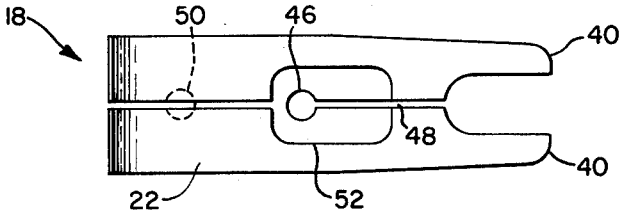

The spring is a flat leaf spring preferably made of spring steel and formed into substantially a U-shape, as illustrated in FIGS. 3A–3C. The end of each leg of the U-shaped spring is forked. The top leg 20 of the spring serves as the ejector for the shackle, while the bottom leg 22 serves as the bolt.

Figure 4:
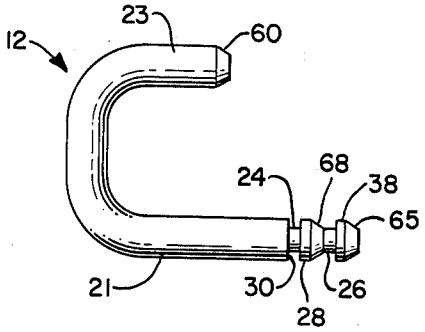
FIG. 4 is a plan view of the shackle.

The shackle is substantially J-shaped and, as illustrated in FIG. 4, has a long leg 21 and a short leg 23. The long leg of the shackle has a pair of spaced notches 24, 26 adjacent to its end. The notches extend around the periphery of the shackle, which preferably is formed from circular steel rod. A shoulder 28 separates the two notches. When the shackle is assembled with the case, the ejector leg 20 of the spring engages notch 24 of the shackle. The bolt leg 22 of the spring is engageable with notch 26 of the shackle. The ejector leg 20 presses against surface 30 of notch 24 to bias the shackle in an upward direction, as viewed in FIGS. 1 and 2, and urges the short leg of the shackle out of the case to the open position of the padlock (FIG. 2).

Figure 5:
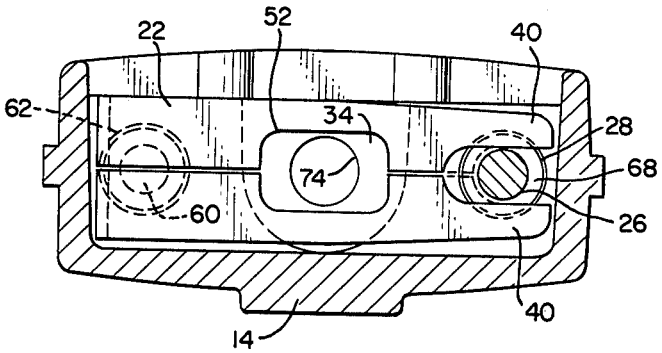
FIG. 5 is a cross-sectional view taken approximately in the plane of line 5—5 of FIG. 1.
Figure 6:
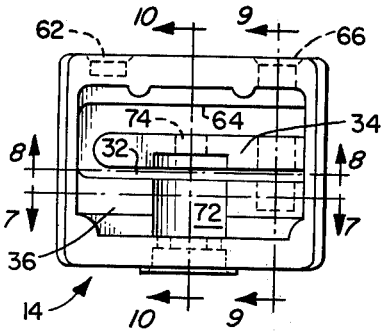
FIG. 6 is a side elevation view of the padlock case.

Bolt leg 22 of the spring is confined in a narrow slot 32 having a width slightly larger than the thickness of the spring. The slot is formed between abutments 34 and 36 within the case. The forked end of the bolt leg 22 is formed to engage a second shoulder 38 adjacent notch 26 at the end of the long leg of the shackle. The distance between the tines 40 of the forked end of the bolt leg is slightly larger than the diameter at the notch 26, permitting the notch to pass between the tines, but such distance is less than the diameter at the shoulder 38. Since the spring 18 normally has the contour shown in FIG. 3B, the shackle is urged in an upward direction, in the relationship of the parts, as viewed in FIG. 1. This is due to tines 42 of the ejector leg 20 of the spring engaging and pushing upwardly against surface 30. Tines 40 of the bolt leg 22, however, engage shoulder 38, thereby preventing the shackle from moving to the unlocked position. The relationship between the diameters of the shackle and notch 26, and the distance between tines 40, is illustrated in FIG. 5. Similarly, the distance between tines 42 of ejector leg 20 is slightly greater than the diameter at notch 24.

Each leg of spring 18 has a centrally located longitudinal split which is operative to permit the tines of the forked ends to be spread apart. A longitudinal split 44 extends from a circular hole 46 positioned at an intermediate point in ejector leg 20 to its forked end. A second longitudinal split 48 extends from the forked end of bolt leg 22 the entire length of leg 22 and around the bend in spring 18 to a second circular hole 50 positioned in the ejector leg. Accordingly, as shown in FIGS. 3A and 3C, the spring is split throughout its length except for the solid portion between holes 46 and 50, which serves to hold the spring together as an integral unit. An elongated hole 52 is centrally positioned in the bolt leg so that it is bisected by split 48, as illustrated in FIG. 3C. The hole or opening 52 may be of any suitable contour, such as oval or generally rectangular as shown. The split 48 and hole 52 cooperate to permit the tines 40 of the bolt leg to be spread apart in a direction transverse to the longitudinal axis of the bolt leg by an amount sufficient to disengage the bolt leg from the shackle.

To open the lock, a key 54, partially shown in FIG. 2, having a flat end portion 56 sized to pass through hole 52 is inserted into the case. The width of the flat portion 56 is slightly less than the length of hole 52 so that it may be inserted through the hole. However, when the key is rotated so that the flat end portion is transverse to the longitudinal dimension (length) of the hole, it contacts the sides of the hole which are generally parallel to split 48 and forces tines 40 to spread apart sufficiently to permit the shoulder 38 to pass between the tines, thereby releasing the shackle from engagement with the bolt. The two legs of the spring operate independently. When the bolt leg is spread to disengage from the shackle, the ejector leg acts upon the shackle to urge the shoulder 38 past the tines 40, whereby the shackle is moved to the unlocked position of FIG. 2.

As illustrated in FIGS. 1 and 2, the ejector leg 20 of the spring resides in a cavity 58 within the case which is formed between abutments 34 and 64. The dimensions of the cavity are sufficient to permit the ejector leg to move the shackle out of engagement with the bolt and for the tip 60 of the short leg of the shackle to move out of the case. The shackle can then be rotated about an axis provided by its long leg to permit the lock to be used in a manner well known in the art.

To lock the padlock, the short leg is aligned with a receptor hole 62 and the shackle is pushed back into the case in a downward direction from the position shown in FIG. 2 to the position shown in FIG. 1. The downward movement of the shackle moves ejector leg 20 toward abutment 34 due to the compressive force of surface 30 upon tines 42. The tip 65 of the leg 21 of the shackle is tapered so that is acts as a cam to spread the tines 40 of the bolt leg apart as it passes through. As a result, the tines 40 reenter the notch 26, and the bolt leg 22 of the spring acts to lock the padlock.

The amount of the upward movement which the shackle can experience is limited by the amount that ejector leg 20 can move within cavity 58. The ejector leg moves upward, as viewed in FIG. 2, until its end contacts abutment 64 which forms the upper wall of cavity 58. Since the forked end of the ejector leg remains in engagement with notch 24 of the shackle, it prevents the long leg of the shackle from moving out of the case and being lost. The dimensions of cavity 58 between abutments 34 and 64 ensure adequate movement of the ejector leg to permit the tip 60 of the short leg of the shackle to clear the top of receptor hole 62 and to permit notch 26 to more out of engaging relationship with the forked end of the bolt.

The longitudinal split 48, which extends the entire length of bolt leg 22 and into ejector leg 20, permits tines 40 of the bolt to be spread sufficiently to clear shoulder 38 of the shackle. Longitudinal split 44, which extends to approximately the middle of ejector leg 20, permits tines 42 of the ejector leg to spread sufficiently to permit easy assembly of the lock. Once assembled, tines 42 remain engaged with notch 24. The independent spreading of the two legs of the spring is facilitated by the holes 46, 50 which terminate longitudinal slits 44 and 48.

To assemble the padlock, the long leg of the shackle is inserted into a receptor hole 66 in the case to approximately the position illustrated in FIG. 2. The spring is then inserted, forked ends first, with the ejector portion of the spring engaging notch 24 of the shackle. The spring is then pushed into place so that the bolt leg enters slot 32 of the case and the ejector leg enters cavity 58. A cover plate 16 for the case completes the assembly. Alternatively, the padlock may be assembled by first positioning the spring in the case and then inserting the shackle. The tapered end 65 of the long leg acts as a cam, as previously described, to spread the tines 42 of the ejector leg of the spring until they engage notch 26. To permit the shackle to be further inserted into the case so that the ejector leg engages notch 24, as required, the shackle may be provided with a second tapered portion 68 between notch 26 and shoulder 28, as illustrated in FIG. 4. Taper 68 also functions as a cam in the same manner as taper 65 to spread tines 42 so that the shackle may be inserted until the ejector leg engages notch 24.

Instead of a pair of notches 24, 26, separated by a shoulder 38, shackle 12 could obviously be provided with a single notch having the same length as the distance between surface 30 and shoulder 38 and shoulder 28 eliminated. However, in the unlocked position, as illustrated in FIG. 2, this would permit the shackle to jiggle in the case and impart an "insecure" feel to the padlock. It is preferable that a pair of notches separated by a shoulder be employed, as illustrated, so that the amount of in and out movement which the shackle can experience is limited. As illustrated in FIG. 2, the movement of the shackle out of the case also is limited by shoulder 28 contacting the ejector leg of the spring.

It is an advantage of the padlock provided by the preferred form of the invention that it has only four component parts, i.e., a shackle, a spring, a case, and a cover plate. In addition, of course, a key is required to open the lock. As is obvious from the foregoing description, the padlock is very easily and quickly assembled. Furthermore, it comprises only two moving parts, the shackle and the spring, which minimizes the possibility of the padlock malfunctioning. The dual function of the spring, serving as both an ejector and as a bolt, is a significant feature of the invention which contributes to its relative simplicity.

Figure 7:
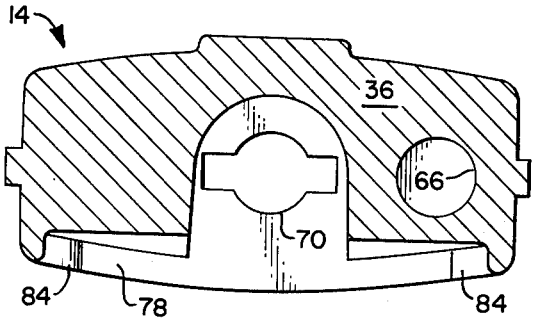
FIG. 7 is an enlarged horizontal cross-sectional view of the case taken approximately in the plane of line 7—7 of FIG. 6.
Figure 8:
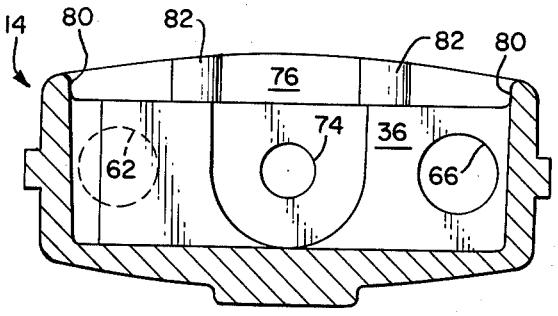
FIG. 8 is an enlarged horizontal cross-sectional view of the case taken approximately in the plane of line 8—8 of FIG. 6.

The details of the construction of case 14 are illustrated in FIGS. 5–10. The case is preferably die cast as a single part from a suitable material such as a zinc alloy. The bottom of the case has a keyhole 70 through which a key is inserted (FIG. 7). Within the case are holes 72, 74 formed in abutments 34, 36, which furnish a key path for guiding a key inserted into the case. Hole 72 connects with keyhole 70 and has a diameter large enough to permit the key to be rotated in the hole. Hole 74 serves as a guide hole for the tip end of the key, which preferably has a mating portion 75 which enters hole 74 when the key is inserted into the case.

The top of the case has receptor holes 62, 66 for the short leg 23 and the long leg 21 of the shackle, respectively. Receptor hole 66 extends from the top of the case, through abutments 34, 64 and for a substantial distance into abutment 36. The depth of this hole is sufficient to accommodate the long leg of the shackle when the padlock is in the locked position. Receptor hole 62, on the other hand, needs to extend only a sufficient distance into the top of the case to accommodate the short leg of the shackle when the padlock is in the locked position.

Figure 9:
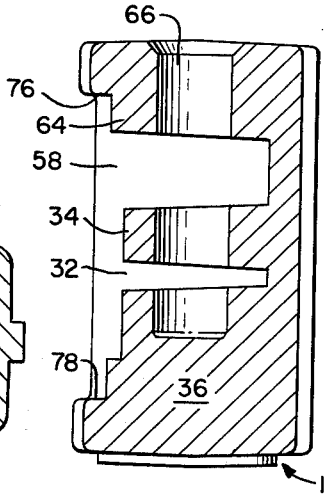
FIG. 9 is an enlarged vertical cross-sectional view of the case taken approximately in the plane of line 9—9 of FIG. 6.
Figure 10:
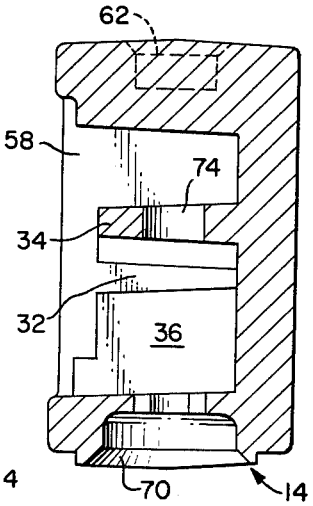
FIG. 10 is an enlarged vertical cross-sectional view of the case taken approximately in the plane of line 10—10 of FIG. 6.

Slot 32 which holds the bolt leg of the spring and cavity 58 which accommodates the ejector leg are formed between abutments 34, 36, and 64, as illustrated in FIG. 9. As previously mentioned, it is preferred that the width of slot 32, i.e., in the vertical dimension as viewed in FIGS. 9 and 10, be only slightly larger than the thickness of spring leg 22 to closely capture the spring leg in the slot. It is desirable to restrain the movement of the shackle in a vertical direction when the padlock is locked. This is further accomplished by slot 32 restricting the vertical movement of the bolt leg 22. The depth of slot 32 in the case, i.e., the horizontal dimension as viewed in FIGS. 9 and 10, is sufficient to accommodate the width of spring 18 and permit the tines of the bolt leg to be spread sufficiently to disengage from the shackle. Similarly, the dimensions of cavity 58 are sufficient to permit adequate movement of the shackle to open the lock, as previously described.

As illustrated, one side of the case is formed with a large, substantially rectangular opening to provide access to the interior of the case for assembly of the components. The opening is adapted to receive a cover plate 16. Adjacent to the rectangular opening, ledges 76 and 78 are formed in the top and bottom of the case, respectively. Similar ledges 80 are formed along the sides of the case adjacent to the opening. Positioned in the top ledge 76 of the case are a pair of rounded shoulders 82 which mate with corresponding cutouts provided in the cover plate 16. Likewise, in the corners of the bottom ledge 78 adjacent to the side ledges 80, rounded shoulders 84 are formed which also mate with corresponding cutouts in the cover plate 16. When the shackle and spring have been assembled in the case, the cover plate, which is dimensioned to fit snugly between ledges 76, 78 and 80 is positioned over the rectangular opening so that the shoulders 82, 84 mate with the corresponding cutouts in the cover plate. The cover plate can then be pressed into place to enclose the case and complete the assembly. It is an advantage that the case can be constructed as a single die cast part, thereby minimizing cost of manufacture. The holes for the key path and for the shackle may be achieved by movable cores in the mold as the case is cast, as is well known in the art. After casting, the case may be plated with chromium or brass, if desired, to give it an attractive finish.

In the preferred embodiment illustrated, a single spring serves as both the bolt and the ejector. Although not as desirable, two separate springs, having their ends remote from the tines fixed within the case, may be employed.

While the foregoing description has been with reference to a particular preferred embodiment, it will be appreciated by those skilled in the art that numerous variations are possible without departing from the spirit and scope of the invention, which is intended to be limited only by the appended claims.

I claim:

1. A padlock comprising a shackle, a case to receive the shackle, the shackle being movable within the case between locked and unlocked positions, a first elongated, substantially flat spring member confined within an elongated slot in the case with the plane of the first spring member and the slot being substantially perpendicular to the direction of movement of the shackle, the first spring member having an end portion engageable with the shackle for preventing movement of the shackle to unlocked position and having means cooperable with a key for moving said first spring member laterally within the plane of the slot to disengage the end portion from the shackle, and a second spring member within the case for urging the shackle to unlocked position.

2. The padlock of claim 1, wherein the case has a bore in which the shackle moves, the bore being substantially perpendicular to the plane of the slot and intersecting the slot.

3. The padlock of claim 1, wherein the first and second spring members are the legs of a substantially U-shaped spring.

4. The padlock of claim 1, wherein the first spring member has a pair of arms adapted to be spread apart by said key to disengage said end portion from the shackle.

5. The padlock of claim 4, wherein the shackle has a notch therein, and said end portion is adapted to enter the notch when the shackle is in locked position.

6. The padlock of claim 5, wherein the shackle has a cam surface adjacent to the notch for spreading the arms of the first spring member to enable the shackle to move to locked position.

7. A padlock comprising a shackle having a notch adjacent to one end thereof, a case to receive the shackle, a first spring member within the case, the first spring member being flat and having a forked end portion engageable with the notch to restrain the movement of the shackle, a longitudinal split extending to the forked end, and an elongated hole formed to receive a key and to cooperate with the split to enable the tines of the forked end to be spread out of engagement with the notch to unlock the padlock, and a second spring member within the case for urging the shackle out of the case.

8. The padlock of claim 7, wherein the second spring member is flat and has a forked end portion.

9. The padlock of claim 8, wherein the second spring member has a longitudinal split therein extending from an intermediate portion thereof to its forked end.

10. The padlock of claim 7 comprising a flat spring formed into a substantially U-shape, the legs of the spring being the first and second spring members.

11. A padlock comprising a shackle having first and second notches adjacent to one end thereof, a case to receive the shackle, and a flat, substantially U-shaped spring within the case, the legs of the spring constituting first and second spring members, each having a forked end engageable with the first and second notches, respectively, the first spring member serving as a bolt for restraining the movement of the shackle and having a longitudinal split extending from its forked end to an intermediate position of the spring, and the second spring member urging the shackle out of the case.

12. The padlock of claim 11, wherein the second spring member includes a longitudinal split extending from the forked end of the second spring member to another intermediate position of the spring, the intermediate positions being located in the second spring member.

13. The padlock of claim 12, wherein the first spring member includes an elongated hole therein formed to receive a key and cooperate with the first-mentioned longitudinal split to disengage the forked end of the first spring member from the shackle to open the padlock.

14. The padlock of claim 11, wherein the shackle is substantially J-shaped with one leg longer than the other, the longer leg having the notches adjacent to its end, and the case has a pair of openings to receive the legs of the shackle, and wherein the shorter leg of the shackle is moved out of the case by the action of the second spring member when the shackle is disengaged from the first spring member, thereby opening the padlock.

* * * * *